US006726513B2

(12) United States Patent
Matsuda

(10) Patent No.: US 6,726,513 B2
(45) Date of Patent: Apr. 27, 2004

(54) JET-PROPULSION PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/236,317

(22) Filed: Sep. 5, 2002

(65) Prior Publication Data

US 2003/0045188 A1 Mar. 6, 2003

(30) Foreign Application Priority Data

Sep. 6, 2001 (JP) ..... 2001-269999

(51) Int. Cl.[7] ..... B63H 21/38

(52) U.S. Cl. ..... 440/88 R; 440/88 A; 440/88 L; 440/89 R

(58) Field of Search ..... 440/88 R, 89 R, 440/1, 88 A, 88 L; 114/55.5, 55.57, 55.51; 123/516, 515, 514, 90.37; 277/166

(56) References Cited

U.S. PATENT DOCUMENTS

| | | | | | |
|---|---|---|---|---|---|
| 4,867,461 | A | * | 9/1989 | Shimmell | 277/593 |
| 5,490,474 | A | * | 2/1996 | Ikeda | 114/55.57 |
| 5,513,603 | A | * | 5/1996 | Ang et al. | 123/90.37 |
| 5,743,206 | A | * | 4/1998 | Hattori | 114/55.51 |
| 5,846,102 | A | * | 12/1998 | Nitta et al. | 440/1 |
| 6,413,130 | B2 | * | 7/2002 | Hattori | 440/88 R |
| 6,447,351 | B1 | * | 9/2002 | Nanami | 440/88 R |

* cited by examiner

*Primary Examiner*—S. Joseph Morano
*Assistant Examiner*—Lars A. Olson
(74) *Attorney, Agent, or Firm*—Kolisch Hartwell, P.C.

(57) ABSTRACT

Disclosed is a jet-propulsion personal watercraft capable of easily removing and mounting an engine and easily performing maintenance of the engine mounted in a body of the watercraft. In an engine mounted in an engine room having an opening in an upper portion thereof, an exhaust pipe connecting face, an air-intake pipe connecting face, and an oil filter mounting face, which are formed in the engine, are configured to be located in the opening as seen from a direction in which the opening is opened.

8 Claims, 7 Drawing Sheets

JET-PROPULSION PERSONAL WATERCRAFT

BACKGROUND OF THE INVENTION

1. Field of the Invention

The present invention relates to a jet-propulsion personal watercraft (PWC) which ejects water rearward and planes on a water surface as the resulting reaction.

2. Description of the Related Art

In recent years, so-called jet-propulsion personal watercraft, which is one type of small watercraft, have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

An engine for driving the water jet pump is mounted in an engine room defined by a deck and a hull of the personal watercraft. An opening is provided in an upper portion of the deck so as to communicate with the engine room. Through the opening, inspection and maintenance of the engine in the engine room are carried out. When overhauling the engine, an exhaust pipe, an air-intake pipe, and an air cleaner box, and the like, which are connected to the engine, are removed from the engine, and then the engine is taken out of the engine room through the opening.

In a straddle-type personal watercraft, a straddle-type seat is typically mounted above the opening. Thus, the width of the opening in the above-mentioned deck is limited by the rider's straddle position, that is, by the dimensions of a seat suitable to be straddled by a rider and possibly a passenger. In addition, in a stand-up type personal watercraft, the size of the opening provided in the deck is limited in view of rigidity of a body of the watercraft.

For the above reasons, it is hard to remove the exhaust pipe, the air-intake pipe, and the like from the engine mounted in the engine room and to take the engine out of the engine room, through the opening. When removing the exhaust pipe, the air-intake pipe, and the like, from the engine, there are many portions which are difficult to see from outside through the opening. Therefore, the removing operation is troublesome and takes a long time. The same is true when the engine is re-mounted into the engine room through the opening, and the exhaust pipe, the air-intake pipe, and the like are connected to the engine mounted in the engine room.

Because of a limited internal space of the body of the personal watercraft, the engine is sometimes mounted in the engine room such that its cylinder is inclined. In a four-cycle engine mounted in such an inclined state, portion where the cylinder head cover is fastened to the cylinder head by means of bolts is sometimes invisible from outside through the opening of the deck. For regular inspection of a valve mechanism covered by the cylinder head cover, the cylinder head cover needs to be removed from the cylinder head, which operation is troublesome.

SUMMARY OF THE INVENTION

The present invention addresses the above condition, and an object of the present invention is to provide a personal watercraft capable of easily removing and mounting an engine and easily performing maintenance of the engine mounted in a body of the watercraft.

According to the present invention, there is provided a jet-propulsion personal watercraft including a water jet pump ejecting water rearward to propel the watercraft as a reaction of the ejecting water, comprising: an engine for driving the water jet pump; an engine room surrounded by a hull and a deck, for containing the engine, the engine room having an opening for maintenance in an upper portion thereof; an exhaust pipe connected to the engine; an air-intake pipe connected to the engine; and an oil filter mounted to the engine, and the engine including: an exhaust pipe connecting face to which the exhaust pipe is connected; an air-intake pipe connecting face to which the air-intake pipe is connected; and an oil filter mounting face to which the oil filter is mounted, wherein the exhaust pipe connecting face, the air-intake pipe connecting face, and the oil filter mounting face are located in the opening as seen from a direction in which the opening is opened.

In the jet-propulsion personal watercraft so constituted, connected end potions of the exhaust pipe and the air-intake pipe, and the mounted portion of the oil filter can be easily checked from outside through the opening formed in the upper portion of the engine room. Therefore, the exhaust pipe, the air-intake pipe, and the oil filter can be easily mounted to/removed from the engine in the engine room. Besides, the engine without the exhaust pipe, the air-intake pipe, and the oil filter, can be put into/taken out of an inside of a body of the watercraft through the opening while keeping the exhaust pipe connecting face, the air-intake pipe connecting face, and the oil filter mounting face out of touch with the periphery of the opening. In such a personal watercraft, inspection and maintenance of the engine can be easily carried out.

Preferably, the oil filter mounting face may be formed such that a normal direction of the oil filter mounting face substantially corresponds with a direction orthogonal to the direction in which the opening is opened or is angled upward with respect to the direction orthogonal to the direction in which the opening is opened. In the jet-propulsion personal watercraft so constituted, the mounting face of the oil filter is visible from outside through the opening of the deck. Therefore, the oil filter can be easily mounted/removed in the state in which the engine is mounted in the engine room.

Preferably, the exhaust pipe connecting face and the air-intake pipe connecting face may be formed such that normal directions of the exhaust pipe connecting face and the air-intake pipe connecting face substantially correspond with a direction orthogonal to the direction in which the opening is opened or are angled upward with respect to the direction orthogonal to the direction in which the opening is opened. In this structure, both the exhaust pipe connecting face and the air-intake pipe connecting face are visible from outside through the opening of the deck. Therefore, the exhaust pipe and the air-intake pipe can be easily mounted/removed in the state in which the engine is mounted in the engine room.

Preferably, the exhaust pipe connecting face, the air-intake pipe connecting face, and the oil filter mounting face may be formed such that normal directions of the exhaust pipe connecting face, the air-intake pipe connecting face, and the oil filter mounting face substantially correspond with a direction orthogonal to the direction in which the opening is opened or are angled upward with respect to the direction orthogonal to the direction in which the opening is opened.

In this structure, the exhaust pipe connecting face, the air-intake pipe connecting face, and the oil filter mounting face are visible from outside through the opening of the deck. Therefore, the exhaust pipe, the air-intake pipe, and the oil filter can be easily mounted/removed in the state in which the engine is mounted in the engine room.

Preferably, the engine may be configured to be smaller than the opening as seen from the direction in which the opening is opened, in a state in which the exhaust pipe, the air-intake pipe, and the oil filter are removed from the engine. In this structure, the engine can be put into/taken out of the inside of the body of the watercraft through the opening.

The engine may be contained in the engine room such that a cylinder is inclined with respect to a vertical direction and the exhaust pipe connecting face, the air intake pipe connecting face, and the oil filter mounting face are located in the opening as seen from the direction in which the opening is opened. In the jet-propulsion personal watercraft so constituted, even when the engine is contained in the engine room such that the cylinder is inclined, the connected end portions of the exhaust pipe and the air-intake pipe, and the mounted portion of the oil filter can be easily checked from outside through the opening in the upper portion of the engine room. Therefore, the exhaust pipe, the air-intake pipe, and the oil filter can be easily mounted to/removed from the engine contained in the engine room. Consequently, in the jet-propulsion personal watercraft, inspection and maintenance of the engine can be easily carried out.

Preferably, the exhaust pipe connecting face and the air-intake pipe connecting face may be formed such that normal directions of the exhaust pipe connecting face and the air-intake pipe connecting face substantially correspond with a direction orthogonal to the direction in which the opening is opened or are angled upward with respect to the direction orthogonal to the direction in which the opening is opened. In this structure, even when the engine is contained in the engine room such that its cylinder is inclined, both of the exhaust pipe connecting face and the air-intake pipe connecting face are easily visible from outside through the opening of the deck.

Preferably, the exhaust pipe connecting face, the air-intake pipe connecting face, and the oil filter mounting face may be formed such that normal directions of the exhaust pipe connecting face, the air-intake pipe connecting face, and the oil filter mounting face substantially correspond with a direction orthogonal to the direction in which the opening is opened or are angled upward with respect to the direction orthogonal to the direction in which the opening is opened. In this structure, the exhaust pipe connecting face, the air-intake pipe connecting face, and the oil filter mounting face are visible from outside through the opening of the deck.

Preferably, the exhaust pipe connecting face, the air-intake pipe, and an air filter mounted to a tip end portion of the air-intake pipe may be located in the opening as seen from the direction in which the opening is opened. In this structure, the engine mounting to and removing from the engine room can be easily carried out.

Preferably, a cylinder head cover accommodating a valve mechanism inside thereof may be fastened to a cylinder head of the engine by means of a screw means and the screw means is configured such that its center axis passes through an inside of the opening. In this structure, the cylinder head cover can be easily attached/detached by mounting/removing the screw means, because a tool such as a wrench can reach the screw means such as the bolt for fastening the cylinder head cover to the cylinder head, through the opening. Therefore, in the state in which the engine is mounted in the engine room, inspection, adjustment and the like of a valve mechanism accommodated in the cover can be easily carried out.

According to the present invention, there is further provided a jet-propulsion personal watercraft including a water jet pump ejecting water rearward to propel the watercraft as a reaction of the ejecting water, comprising: an engine for driving the water jet pump; and an engine room surrounded by a hull and a deck, for containing the engine, the engine room having an opening for maintenance in an upper portion thereof and containing the engine with a cylinder inclined with respect to a vertical direction; and a cylinder head cover fastened to a cylinder head of the engine by means of a screw means, wherein the screw means is configured such that its center axis passes through an inside of the opening.

In the jet-propulsion personal watercraft so constituted, the cylinder head cover can be easily attached/detached by mounting/removing the screw means, because the tool such as the wrench can reach the screw means such as the bolt for fastening the cylinder head cover to the cylinder head, through the opening. Therefore, in the state in which the engine is mounted in the engine room, inspection, adjustment and the like of the valve mechanism accommodated in the cover can be easily carried out.

Preferably, the screw means may be configured such that its center axis is inclined with respect to a face at which the cylinder head cover is attached to the cylinder head.

The above and further objects and features of the invention will more fully be apparent from the following detailed description with accompanying drawings.

DETAILED DESCRIPTION OF THE PREFERRED EMBODIMENTS

Hereinafter, a jet-propulsion personal watercraft according to an embodiment of the present invention will be described with reference to the accompanying drawings.

Figure 1:
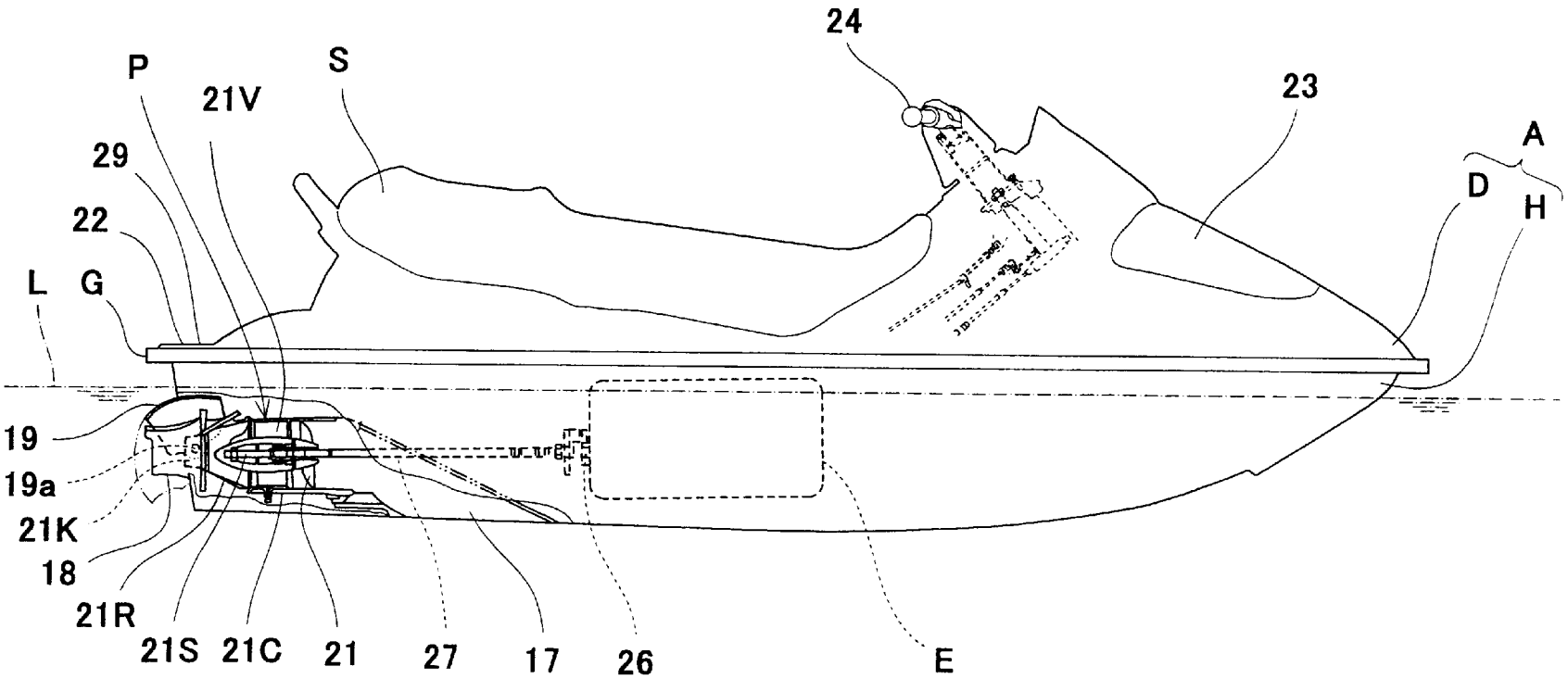
FIG. 1 is a side view showing a personal watercraft according to an embodiment of the present invention.

Referring now to FIG. 1, a straddle-type personal watercraft having a seat on which a rider straddles is shown. A body A of the watercraft comprises a hull H and a deck D covering the hull H from above. A line at which the hull H and the deck D are connected over the entire perimeter thereof is called a gunnel line G. The gunnel line G is located above a waterline L of the watercraft.

Figure 2:
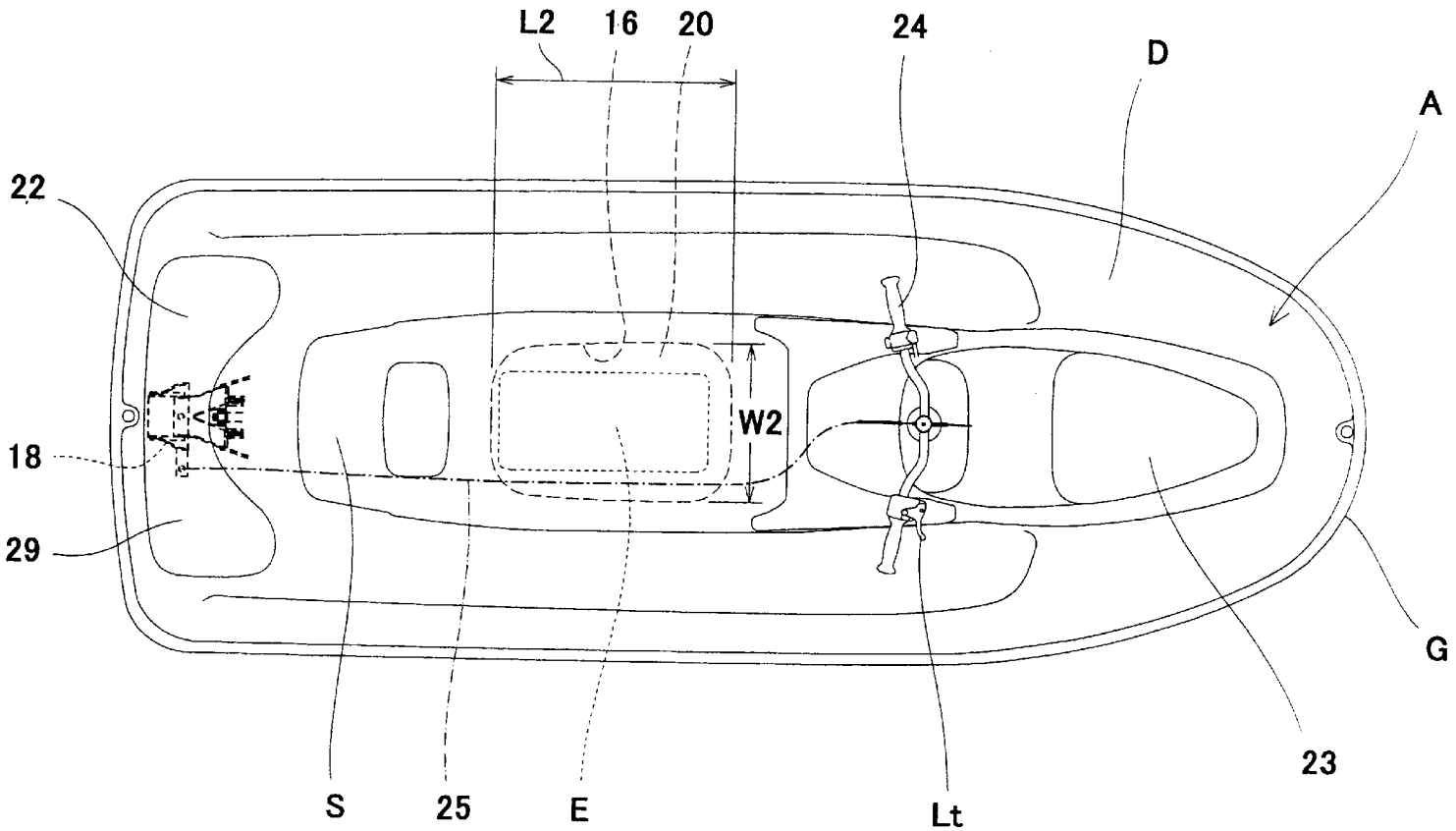
FIG. 2 is a plan view showing the personal watercraft in FIG. 1.

As shown in FIG. 2, an opening 16, which has a substantially rectangular shape as seen from above is formed at a substantially center section of the deck D in the upper portion of the body A such that its longitudinal direction corresponds with the longitudinal (front-and-rear) direction of the body A. The length in the longitudinal direction and the width in the lateral (right-and-left) direction of the opening 16 are represented by L2, W2 (in this embodiment, L2>W2), respectively. As shown in FIGS. 1, 2, a seat S is removably mounted over the opening 16. The seat S has a proper width to permit the rider or passenger to easily straddle. The width W2 of the opening 16 is limited according to the size of the seat S.

An engine room 20 is provided in a space defined by the hull H and the deck D below the opening 16. An engine E for driving the personal watercraft is mounted in the engine room 20. The engine room 20 has a convex transverse cross-section such that its width is smaller in its upper portion than in its lower portion. In this embodiment, the engine E is a four-cylinder four-cycle engine. As shown in FIG. 1, the engine E is mounted such that a crankshaft 26 is placed along the longitudinal direction of the body A.

An output end of the crankshaft 26 is rotatably coupled integrally with a pump shaft 21S of a water jet pump P provided on the rear side of the body A through a propeller shaft 27. An impeller 21 is attached on the pump shaft 21S of the water jet pump P. Fairing vanes 21V are provided behind the impeller 21. The impeller 21 is covered with a pump casing 21C on the outer periphery thereof.

A water intake 17 is provided on the bottom of the body A. The water intake 17 is connected to the pump casing 21C through a water intake passage. The pump casing 21C is connected to a pump nozzle 21R provided on the rear side of the body A. The pump nozzle 21R has a cross-sectional area of gradually reduced rearward, and an outlet port 21K is provided on the rear end of the pump nozzle 21R.

The water is sucked from the water intake 17 and fed to the water jet pump P. The water jet pump P pressurizes and accelerates the water and the fairing vanes 21V fair water flow behind the impeller 21. The water is ejected through the pump nozzle 21R and from the outlet port 21K, and as a reaction of the ejecting water, the watercraft obtains a propulsion force.

In FIGS. 1, 2, reference numeral 24 denotes a bar-type steering handle. The steering handle 24 is connected to a steering nozzle 18 provided behind the pump nozzle 21R through a cable 25 (indicated by dashed line in FIG. 2). When the rider rotates the handle 24 to clockwise or counterclockwise, the steering nozzle 18 is swung toward the opposite direction so that the ejection direction of the water being ejected through the pump nozzle 21R can be changed and the watercraft can be correspondingly turned to any desired direction while the water jet pump P is generating the propulsion force.

As shown in FIG. 1, a bowl-shaped reverse deflector 19 is provided above the rear side of the steering nozzle 18 such that it can vertically swing around a horizontally mounted swinging shaft 19*a*.

The deflector 19 is swung downward to a lower position around the swinging shaft 19*a* to deflect the ejected water from the steering nozzle 18 forward, and as the resulting reaction, the personal watercraft moves rearward.

In FIGS. 1, 2, a rear deck 22 is provided in the rear section of the body A. The rear deck 22 is provided with an openable rear hatch cover 29. A rear compartment (not shown) with a small capacity is provided under the rear hatch cover 29. In FIGS. 1, 2, a front hatch cover 23 is provided in a front section of the body A. A front compartment (not shown) is provided under the front hatch cover 23 for storing equipments and the like.

Figure 3:
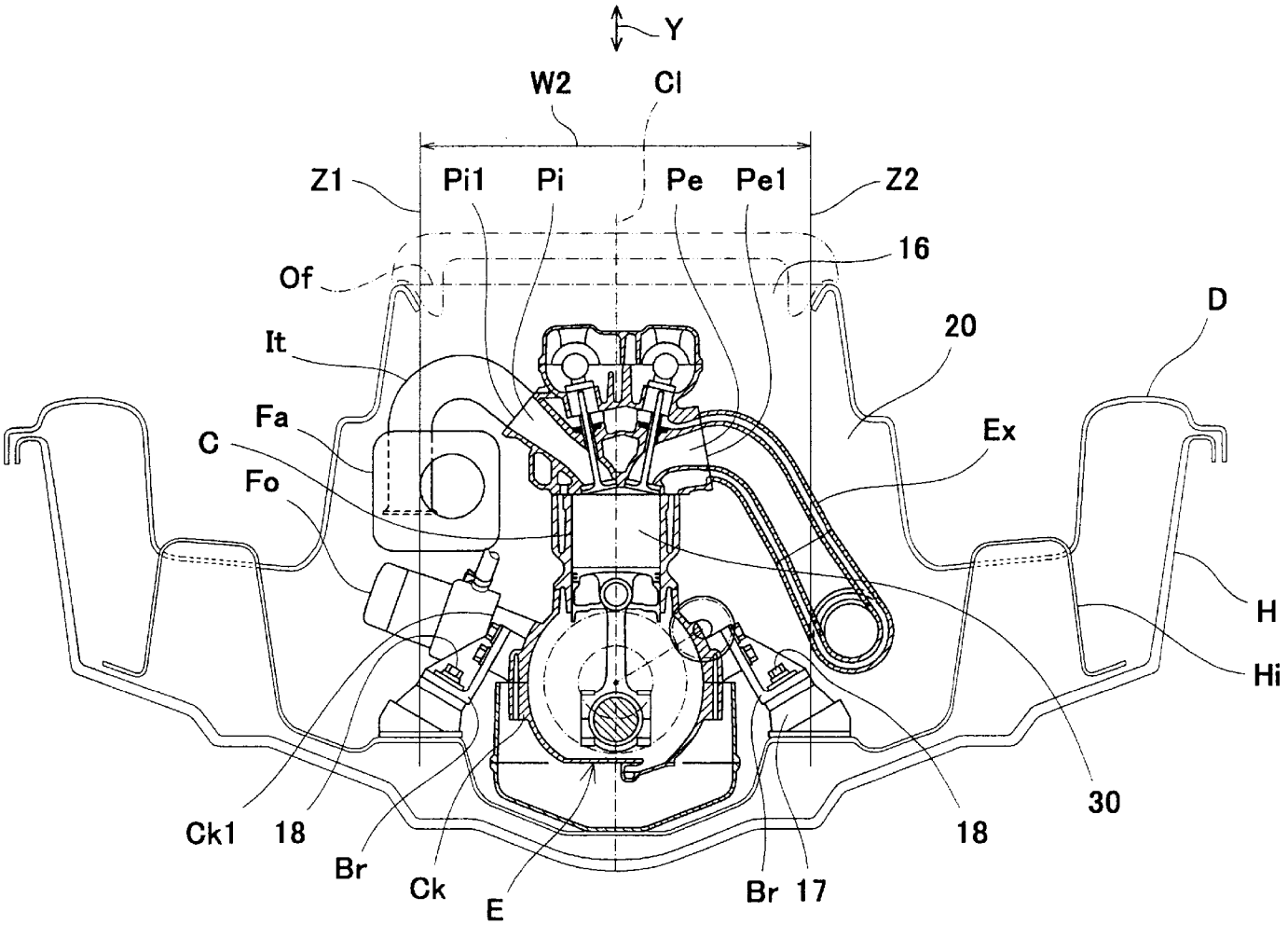
FIG. 3 is a transverse cross-sectional view of the personal watercraft, which is sectioned at an engine room portion, showing that the engine is mounted in the personal watercraft in FIG. 1.

Subsequently, a structure of main part of the present invention will be described. As shown in FIG. 3, the engine E is mounted in the engine room 20 surrounded by the hull H and the deck D. The engine E is placed such that a piston 30 reciprocates substantially vertically, i.e., a cylinder extends substantially vertically. The engine E is mounted in the engine room 20 in such a manner that brackets Br fixed to a crankcase Ck of the engine are fixed to an engine mount 17 on an inner hull Hi formed on an inner surface of the hull H by means of mounting bolts 18.

The engine E has an exhaust port Pe and an air-intake port Pi in a cylinder head. A base end portion of an exhaust pipe Ex is connected to an exhaust pipe connecting face Pe1 formed in an end face of the exhaust port Pe and a base end portion of an air-intake pipe It is connected to an air-intake pipe connecting face Pi1 formed in an end face of the air-intake port Pi. An air filter Fa is mounted to a tip end portion of the air-intake pipe It. An oil filter mounting face Ck1 for mounting the oil filter Fo is formed on a side portion of the crankcase Ck of the engine E, and the oil filter Fo is mounted to the oil filter mounting face Ck1.

In the state in which the engine E is mounted in the engine room 20, the exhaust pipe connecting face Pe1, the air-intake pipe connecting face Pi1, and the oil filter mounting face Ck1 are respectively located in the opening 16 as seen from the outside of the body A in the direction in which the opening 16 is opened, i.e., vertical direction of the body A or the normal direction of an opening face Of in this embodiment, as indicated by an arrow Y in FIG. 3.

More detail will be described with reference to FIG. 3. When imaginary lines extending from right and left edges of the opening 16 toward the direction in which the opening 16 is opened, are represented by Z1, Z2, the exhaust pipe connecting face Pe1, the air-intake pipe connecting face Pi1, and the oil filter mounting face Ck1 of the engine E are respectively located between the imaginary lines Z1, Z2. The engine E with the bracket Br fixed thereto is sized to be smaller than the length L2 and the width W2 of the opening 16 so that the engine E without the exhaust pipe Ex, the air-intake pipe It, and the oil filter Fo is accommodated in the opening 16 as seen from the direction indicated by the arrow Y. It should be appreciated that, when the engine E can be taken out through the opening 16, the length of the engine E in the longitudinal direction may be slightly larger than the length L2 of the opening 16. It should be also appreciated that, as long as the engine E can be put into/taken out through the opening 16 with the brackets Br mounted to the engine E, the bracket Br is not necessarily to be located in the width W2 of the opening 16.

Figure 4:
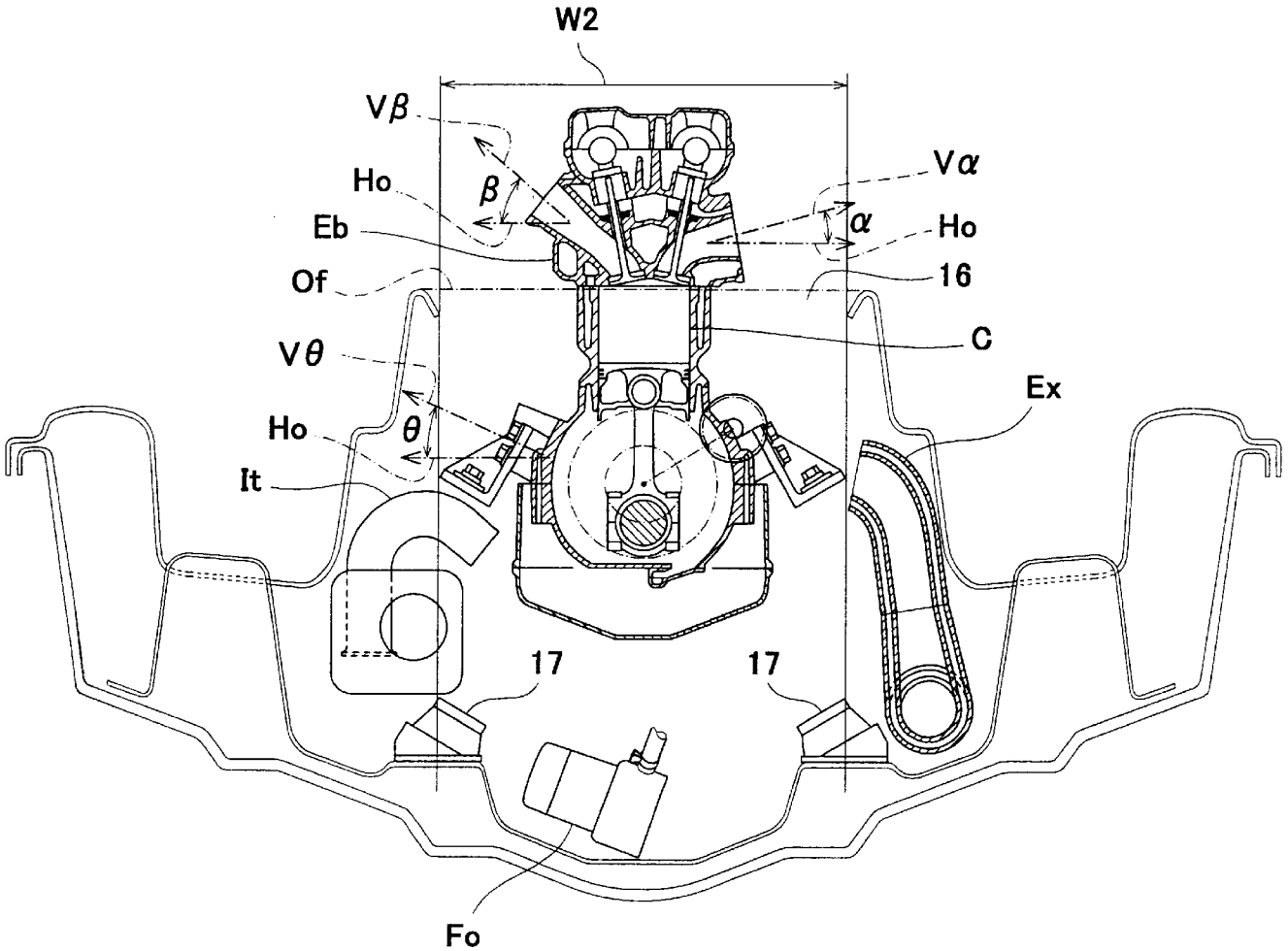
FIG. 4 is a schematic view showing a state in which the engine is located in an opening of a deck in the personal watercraft in FIG. 3.

The exhaust pipe connecting face Pe1, the air-intake pipe connecting face Pi1, and the oil filter mounting face Ck1 are inclined such that normal directions of these faces are angled upward with respect to the direction orthogonal to the direction in which the opening 16 is opened, i.e., substantially horizontal direction Ho, in this embodiment. Specifically, as shown in FIG. 4, the exhaust pipe connecting face Pe1 is inclined such that a normal direction Vα of the connecting face Pe1 is angled upward at an angle α ($0° \leqq \alpha \leqq 90°$) with respect to the substantially horizontal direction Ho. Likewise, the air-intake pipe connecting face Pi1 is inclined such that a normal direction Vβ of the connecting face Pi1 is angled upward at an angle β (0°≦β≦90°) and the oil filter mounting face Ck1 is inclined such that a normal direction Vθof the mounting face Ck1 is angled upward at an angle θ (0°≦θ≦90°) with respect to the substantially horizontal direction Ho.

In the personal watercraft so constituted, the exhaust pipe connecting face Pe1, the air-intake pipe connecting face Pi1, and the oil filter mounting face Ck1 of the engine E mounted in the engine room 20 are respectively visible from outside through the opening 16. Therefore, the exhaust pipe Ex, the air-intake pipe It, and the oil filter Fo can be easily removed from the engine E. Besides, the exhaust pipe Ex, the air-intake pipe It, and the oil filter Fo can be easily mounted to the engine E mounted in the engine room 20.

By removing the exhaust pipe Ex, the air-intake pipe It, and the oil filter Fo from the engine E and removing the mounting bolts 18 for mounting the engine E to the engine mount 17, the engine E can be vertically lifted and taken out through the opening 16 while maintaining its mounted posture. Besides, the engine E can be vertically lowered into and mounted in the engine room 20 through the opening 16 while maintaining its mounted posture.

Figure 5:
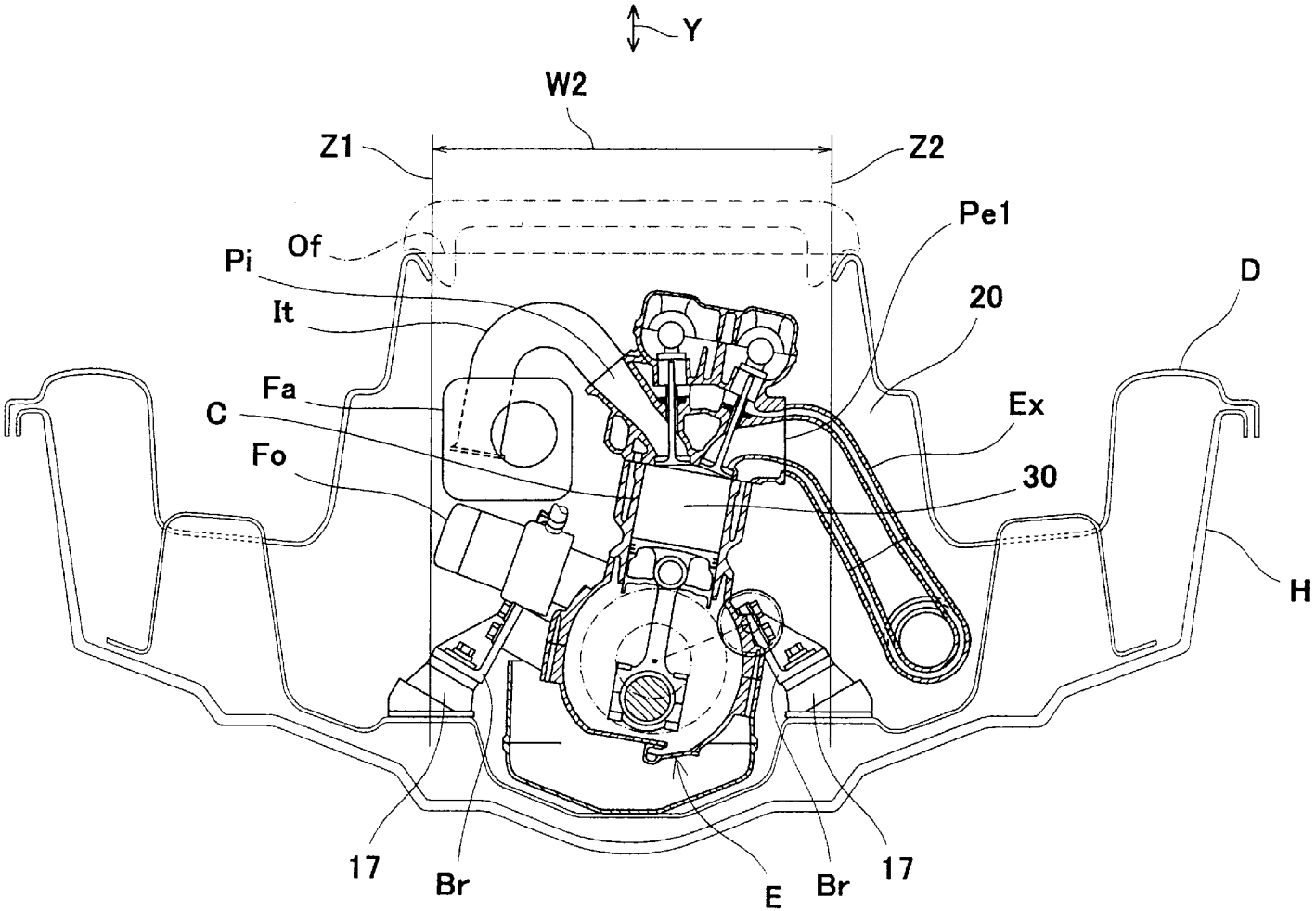
FIG. 5 is a transverse cross-sectional view of the personal watercraft, which is sectioned at the engine room portion, showing that the engine is mounted in the personal watercraft in a way different from that of FIG. 3.

Subsequently, the jet-propulsion personal watercraft according to another embodiment of the present invention will be described. As shown in FIG. 5, the engine E is mounted in the engine room 20 in such a manner that the piston 30 reciprocates in a state slightly inclined with respect to a vertical direction. In other words, the engine E is mounted in the engine room 20 such that the cylinder C of the engine E is inclined. In the state in which the engine E is mounted in the engine room 20, the exhaust pipe connecting face Pe1 formed in the cylinder head of the engine E, the air-intake pipe It connected to the end face of the air-intake port Pi, the air filter Fa mounted to the tip end portion of the air-intake pipe It, and the oil filter Fo mounted to the side portion of the crankcase Ck, are respectively located in the opening 16 as seen from outside of the body A (FIG. 1) in the direction in which the opening 16 is opened as indicated by the arrow Y in FIG. 5.

As shown in FIG. 5, the exhaust pipe connecting face Pe1 of the engine E, the air-intake pipe It, the air filter Fa, and the oil filter Fo are respectively located between the imaginary lines Z1, Z2 extending as in FIG. 3.

Figure 6:
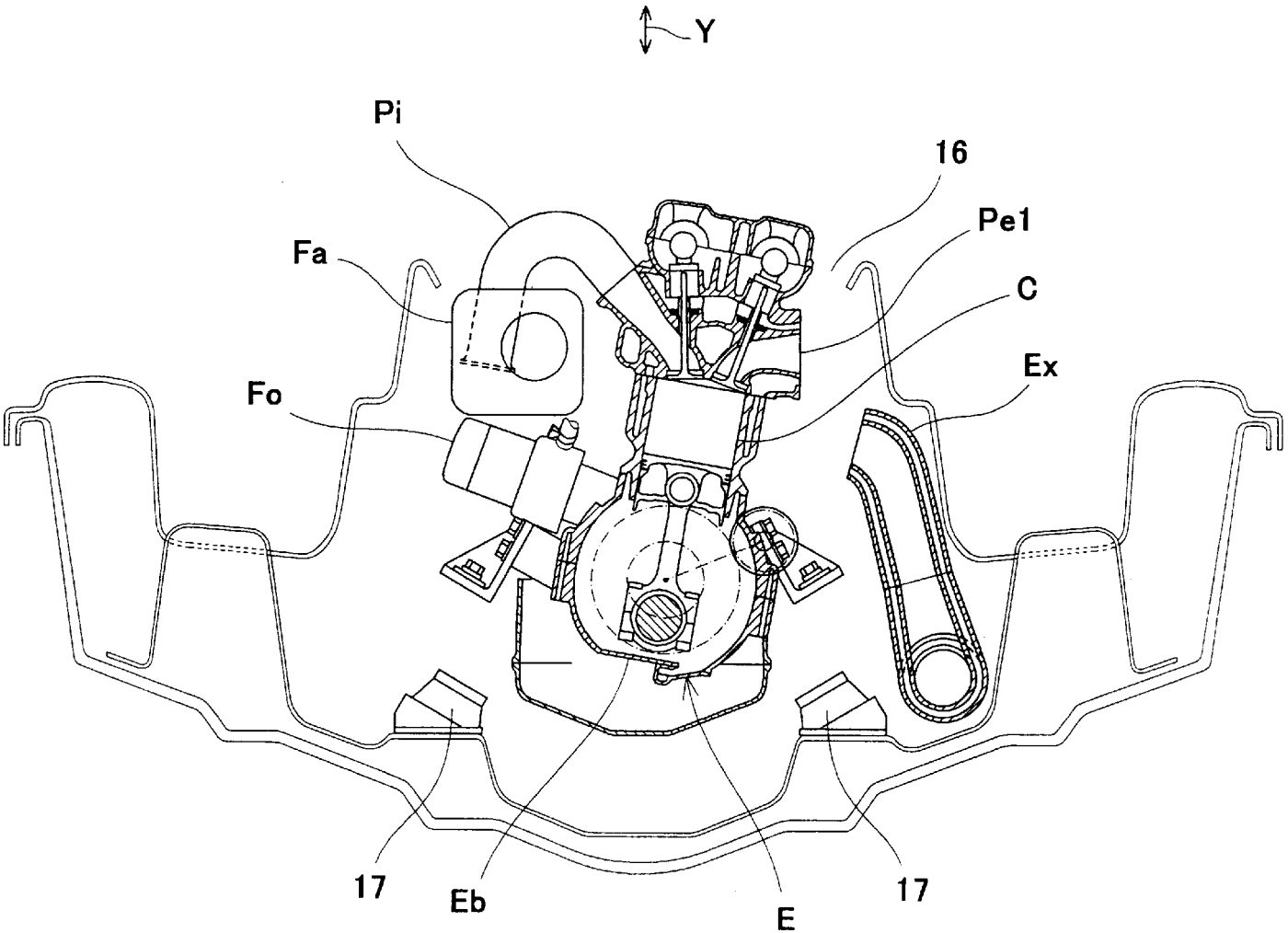
FIG. 6 is a schematic view showing a state in which the engine is located in the opening of the deck in the personal watercraft in FIG. 5.

In the personal watercraft so constituted, as shown in FIG. 6, by removing the exhaust pipe Ex from the exhaust pipe connecting face Pe1 and releasing the engine E from the engine mount 17, the engine E can be vertically lifted and taken out through the opening 16. Besides, the engine E can be vertically lowered into and mounted in the engine room 20 through the opening 16 while maintaining its mounted posture.

Figure 7:
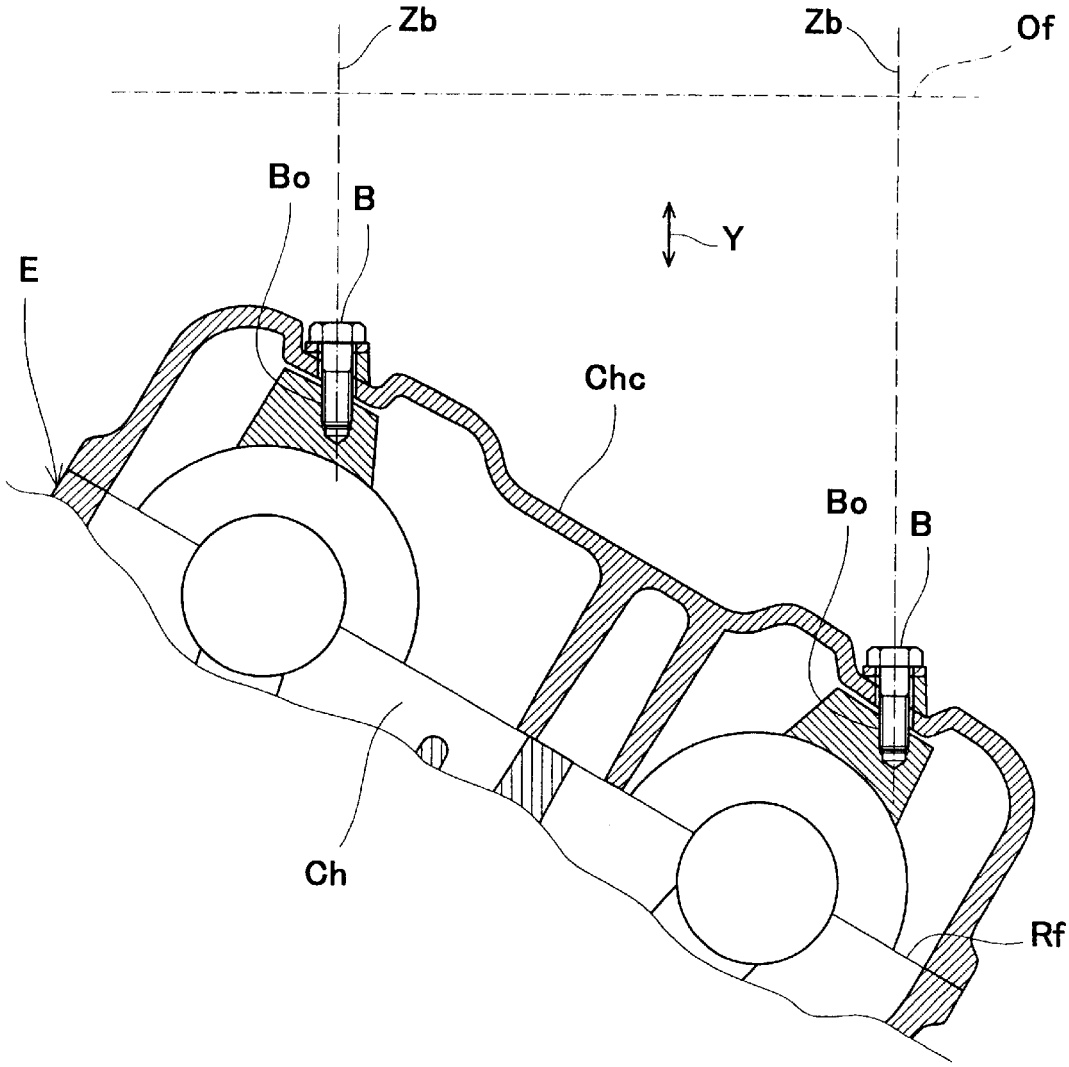
FIG. 7 is a cross-sectional view showing a state in which a cylinder head cover is connected to a cylinder head.

As shown in FIG. 7, a cylinder head cover Chc accommodating a valve mechanism inside thereof is attached to the cylinder head Ch in the upper portion of the engine E. In this embodiment, since the engine E is mounted in the engine room 20 in the inclined state as described above, a connecting face Rf between the cylinder head cover Chc and the cylinder head Ch is inclined at a predetermined angle with respect to an opening face Of of the opening 16.

The cylinder head cover Chc is fixed to bolt holes Bo provided in the cylinder head Ch by means of bolts B. Center axes Zb of the bolt holes Bo are inclined at a predetermined angle with respect to the normal direction of the connecting face Rf. More specifically, in the state in which the engine E is mounted in the engine room 20, the center axes Zb of the bolt holes Bb are adapted to pass through the inside of the opening 16 of the deck D.

Accordingly, even in the state in which the engine E is mounted in the engine room 20 in the inclined state, the cylinder head cover Chc can be easily removed from the engine E by removing the bolts B using a wrench or the like. In this state, then, for example, a tappet adjustment of the valve mechanism can be easily performed.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet-propulsion personal watercraft including a water jet pump ejecting water rearward to propel the watercraft as a reaction of the ejecting water, comprising:

an engine for driving the water jet pump;

an engine room surrounded by a hull and a deck, for containing the engine, the engine room having an opening for maintenance in an upper portion thereof;

an exhaust pipe connected to the engine;

an air-intake pipe connected to the engine; and an oil filter mounted to the engine, and the engine including:

an exhaust pipe connecting face to which the exhaust pipe is connected;

an air-intake pipe connecting face to which the air-intake pipe is connected; and an oil filter mounting face to which the oil filter is mounted, wherein the exhaust pipe connecting face, the air-intake pipe connecting face, and the oil filter mounting face are located in the opening as seen from a direction in which the opening is opened; and wherein the oil filter mounting face is formed such that a normal direction of the oil filter mounting face substantially corresponds with a direction orthogonal to the direction in which the opening is opened or is angled upward with respect to the direction orthogonal to the direction in which the opening is opened.

2. The jet-propulsion personal watercraft according to claim 1, wherein the engine is contained in the engine room such that a cylinder is inclined with respect to a vertical direction.

3. A jet-propulsion personal watercraft including a water jet pump ejecting water rearward to propel the watercraft as a reaction of the ejecting water, comprising:

an engine for driving the water jet pump;

an engine room surrounded by a hull and a deck, for containing the engine, the engine room having an opening for maintenance in an upper portion thereof;

an exhaust pipe connected to the engine;

an air-intake pipe connected to the engine; and an oil filter mounted to the engine, and the engine including:

an exhaust pipe connecting face to which the exhaust pipe is connected;

an air-intake pipe connecting face to which the air-intake pipe is connected; and an oil filter mounting face to which the oil filter is mounted, wherein the exhaust pipe connecting face, the air-intake pipe connecting face, and the oil filter mounting face are located in the opening as seen from a direction in which the opening is opened; and wherein the exhaust pipe connecting face and the air-intake pipe connecting face are formed such that normal directions of the exhaust pipe connecting face and the air-intake pipe connecting face either (a) substantially correspond with a direction orthogonal to the direction in which the opening is opened or (b) are angled upward with respect to the direction orthogonal to the direction in which the opening is opened.

4. The jet-propulsion personal watercraft according to claim 3, wherein the oil filter mounting face is formed such that a normal direction of the oil filter mounting face either (a) substantially corresponds with a direction orthogonal to the direction in which the opening is opened or (b) angled upward with respect to the direction orthogonal to the direction in which the opening is opened.

5. The jet-propulsion personal watercraft according to claim 4, wherein the engine is contained in the engine room such that a cylinder is inclined with respect to a vertical direction.

6. The jet-propulsion personal watercraft according to claim 3, wherein the engine is contained in the engine room such that a cylinder is inclined with respect to a vertical direction.

7. The jet-propulsion personal watercraft according to claim 6, wherein the exhaust pipe connecting face, the air-intake pipe, and an air filter mounted to a tip end portion of the air-intake pipe are located in the opening as seen from the direction in which the opening is opened.

8. A jet-propulsion personal watercraft including a water jet pump ejecting water rearward to propel the watercraft as a reaction of the ejecting water, comprising:

an engine for driving the water jet pump; and an engine room surrounded by a hull and a deck, for containing the engine, the engine room having an opening for maintenance in an upper portion thereof and containing the engine with a cylinder inclined with respect to a vertical direction; and a cylinder head cover fastened to a cylinder head of the engine by means of a screw means, wherein the screw means is configured such that its center axis passes through an inside of the opening; and wherein the screw means is configured such that its center axis is inclined with respect to a face at which the cylinder head cover is attached to the cylinder head.

* * * * *